United States Patent [19]

Figge et al.

[11] 4,433,782

[45] Feb. 28, 1984

[54] MAGAZINE ASSEMBLY FOR COIL NAILS

[75] Inventors: Siegfried E. O. Figge, Newmarket; Herbert E. Leistner, Toronto, both of Canada

[73] Assignee: Sigma Tool & Machine Limited, Scarborough, Canada

[21] Appl. No.: 427,659

[22] Filed: Sep. 29, 1982

[30] Foreign Application Priority Data

Oct. 20, 1981 [CA] Canada ..... 388320

[51] Int. Cl.[3] ..... B65D 85/24

[52] U.S. Cl. ..... 206/338; 29/413; 206/405

[58] Field of Search ..... 206/338, 340, 341, 342, 206/343, 344, 345, 446, 347, 405; 411/442; 29/413

[56] References Cited

U.S. PATENT DOCUMENTS

| | | | |
|---|---|---|---|
| 1,637,931 | 8/1927 | Fontana | 206/338 |
| 2,085,783 | 7/1937 | Borchert et al. | 206/338 |
| 2,145,358 | 1/1939 | Kronquest | 206/338 |
| 3,517,804 | 6/1970 | Faulkner | 206/338 |
| 3,526,257 | 9/1970 | Kirkland | 206/338 |
| 3,895,708 | 7/1975 | Jureit et al. | 206/338 |
| 3,910,512 | 10/1975 | Jureit et al. | 206/338 |

*Primary Examiner*—Joseph Man-Fu Moy

*Attorney, Agent, or Firm*—George A. Rolston

[57] ABSTRACT

A magazine for use with a fastener driving tool employing a strip of fasteners formed into a coil, and having a fixed portion to be fastened to such a tool, wall means forming a portion of said fixed portion for engaging such a coil of fasteners, a mounting member on the fixed portion along an axis centrally of the coil of fasteners, a movable attachment member incorporated in the mounting member, and movable between locking and releasing positions, a movable magazine portion defining wall means adapted to engage the coil of fasteners, exit means on at least one of the fixed and movable magazine portions, for exit of the fasteners, a slidable guide member formed on the movable portion, interengageable with the mounting member, and locking abutment means located inwardly of the guide member, for interengaging with the locking means on said fixed magazine portion.

10 Claims, 4 Drawing Figures

FIG 1
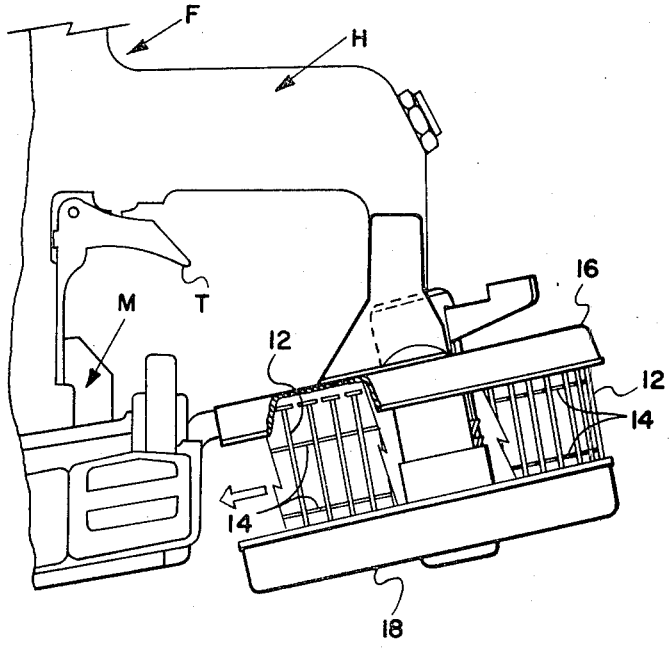
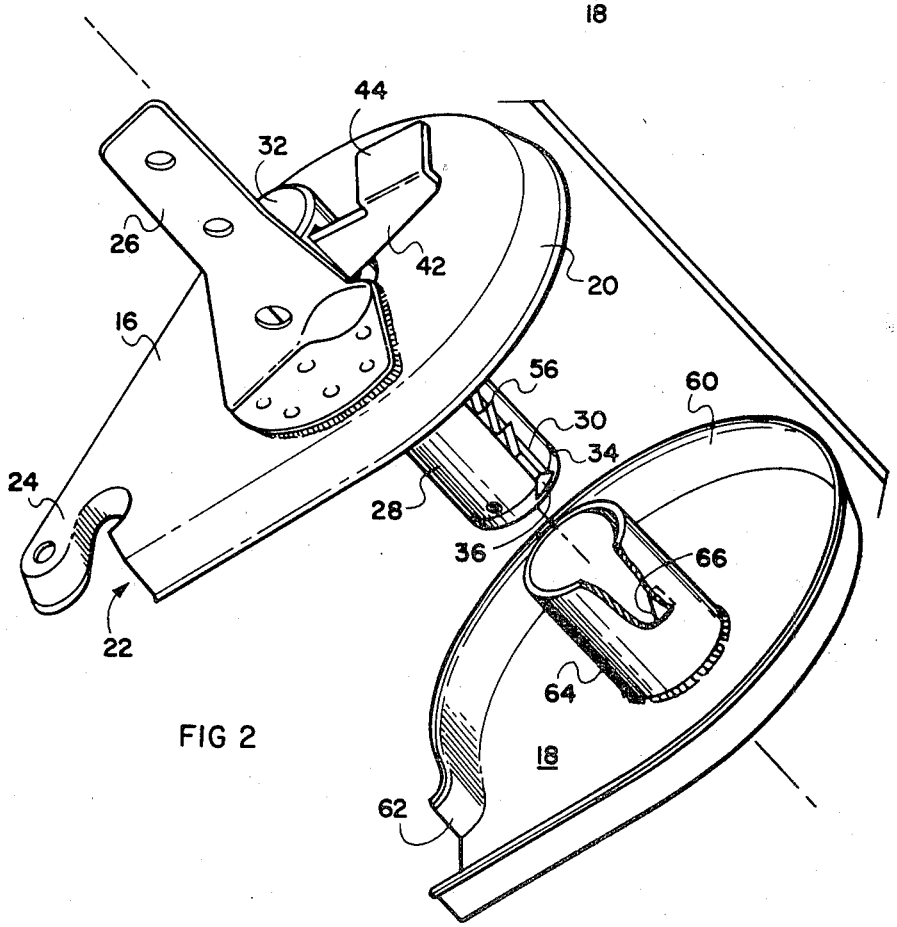
FIG 2

MAGAZINE ASSEMBLY FOR COIL NAILS

The invention relates to a magazine for a fastener driving tool, wherein the fasteners are stored in a coil.

Fastener driving tools such as nailing tools operated by some form of power source employ fasteners, such as nails, which are formed together into a belt or strip. Preferably such belt or strip is formed into a coil, and is then stored in a magazine from which the belt or strip of fasteners may be fed to the nail driving portion of the tool.

It is desireable that such a tool and magazine shall be adaptable to a variety of lengths of different fasteners. In addition, it is desireable that the magazine may be easily dismantled and refilled with a further coil of such fasteners as quickly as possible, when the magazine is exhausted, so that the fastening operations are subjected to only a minimum of interruption.

Such a magazine should therefore be easy to dismantle, reload and reassemble and should be capable of withstanding severe abuse and should provide trouble free operation.

Various such rotary feed magazines have been proposed in the past. Generally speaking, such a magazine comprises a fixed portion which is attached to the main body of the fastener driving tool, and a removable portion which can be removed for refilling the magazine.

In order to accommodate different lengths of nails, the removable portion is usually capable of being fastened to the fixed portion at different axial positions. In addition, some form of quick release fastening mechanism is provided to permit the removable portion to be quickly removed and replaced, without the use of tools.

Typical such magazines are shown in U.S. Pat. Nos. 3,945,551 and 3,688,966.

The magazines disclosed in these patents, are typical but suffer from various disadvantages. In both cases they are relatively speaking of complex manufacture, requiring some degree of precision in manufacture, and incorporating inherent weaknesses such as would be likely to lead to a breakdown in use. In addition, the releaseable fastening mechanism in some cases is inherently likely to fail, and will prove unsatisfactory in use.

It is a general objective of the invention therefore to provide such a rotary or drum type magazine for a fastener driving tool of improved and simplified design offering economies in manufacture and greater reliability in use.

A magazine for a fastener driving tool, said magazine comprising a fixed portion adapted to be fastened to a fastener driving tool, and defining an axis, and having a mounting sleeve member extending downwardly therefrom along such axis, and a movable portion removably attachable to said fixed portion, and defining a central axis, and a telescopic guide member formed thereon, dimensioned and shaped to make a snug sliding fit over said sleeve member, and movable fastening means located within said sleeve member, being movable between locking and releasing positions, and having a plurality of locking members thereon, and an abutment member formed inwardly of said telescopic guide member, extending into engagement with any one of said locking members, whereby said movable portion may be fastened on said sleeve member in various axial positions, corresponding to different ones of said locking members, whereby to accomodate fasteners of different lengths.

It is a further and related objective of the invention to provide such a magazine in which the movable member is a one-piece integrally moulded member formed of a thermoplastic material.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 1 is a side elevational view partially cut away showing a magazine according to the invention, attached to a portion of a typical fastener driving tool;

FIG. 2 is an exploded perspective illustration of the magazine of FIG. 1;

Figure 3:
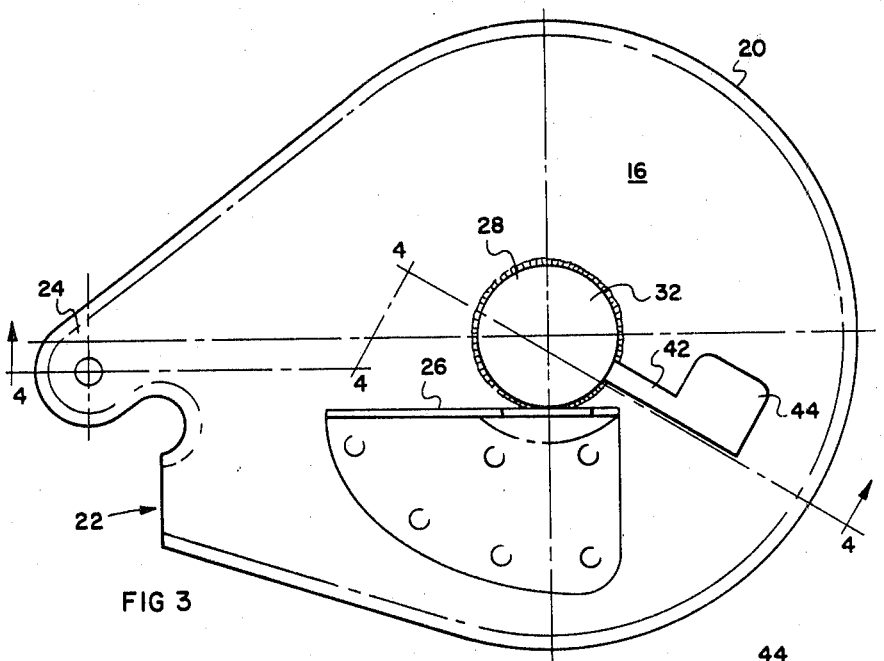
FIG. 3 is a top plan view of the magazine of FIG. 1.

As described above, the magazine according to the invention finds its application principally in association with a fastener driving tool, samples of which are shown in the patents referred to, and there are numerous other examples in the art.

Typically, such a fastener tool, a portion of which is shown in FIG. 1, is indicated generally as F, has a handle H by means of which it may be held by the operator, and has a trigger T by means of which the power operation of the device may be activated. Such power operation may be pneumatic or electric or by any other suitable means, depending upon the design of the particular tool. Again, such a fastening tool F is provided with a fastener feed mechanism M, by means of which a strip of fasteners is fed to the impacting portion of the tool (now shown) which drives the individual fasteners into a workpiece.

As mentioned, all of these features are essentially common to this type of equipment are not illustrated for the sake of clarity.

In accordance with the invention, the magazine for storing the fasteners or nails is indicated generally as 10. It will be understood that such fasteners or nails which are indicated as 12. Typically such fasteners or nails 12 will be formed together into a nailing strip by any suitable binding means. In this case, the binding means comprises two parallel strands of thin wire 14. The wires 14 are spot welded to the individual fasteners 12. Operation of the impacting portion of the fastening tool F breaks the nails away from the wires.

The strip of nails 12 is stored in the form of a coil in the magazine 10, and is fed from the magazine 10 by the operation of the mechanism M of the fastening tool F.

Figure 4:
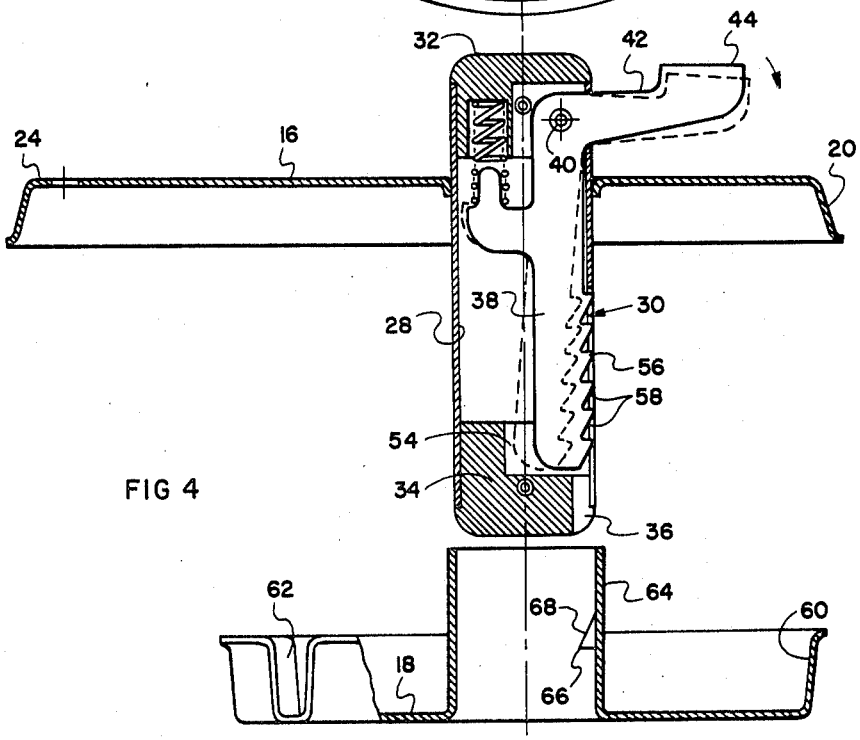
FIG. 4 is a section along the line 4—4 of FIG. 3, showing the magazine disassembled.

As shown in more detail in FIGS. 2, 3 and 4, the magazine 10 will be seen to comprise a fixed portion 16, and a movable portion 18. The fixed portion 16 comprises a generally planar sheet portion, surrounded by a partial wall 20, which is discontinuous at the exit gate 22, to provide a means of exit for the nails or fastenings 12.

An integral mounting flange 24 extends from the fixed portion 16, by means of which it may be attached to the fastening tool F, typically at the mechanism M as shown in FIG. 1.

A further mounting bracket 26 is fastened to fixed member 16, and is attachable to handle H of fastening tool F.

Perpendicular to fixed portion 16 is an axial sleeve 28, which extends along an axis on both sides of fixed portion 16.

Sleeve 28 is formed with an elongated axial slot 30, and is closed at each end by means of upper and lower closure plugs 32, 34. Plug 34 is formed with a notch 36 registering with slot 30. A movable locking arm 38 is swingably mounted within sleeve 28 on pin 40. Arm 38 has an upper L-shaped operating arm portion 42 extending outwardly through the upper end of sleeve 28, through slot 30. A finger plate 44 extends to one side of arm 42 whereby the arm 42 may be operated by the user.

A reaction arm 46 extends from locking arm 38 on the opposite side from operating arm portion 42, and on its free end, is provided with a reduced neck portion 48 extending upwardly parallel to arm 38. A spring 50 is received on neck portion 48, and abuts against the upwardly directed edge of arm 46. The spring 50 is received within a bore 52 formed in upper closure plug 32. Spring 50 normally urges locking arm 38 into an outwardly swung position. Pressure on finger plate 44 will cause arm 38 to swing inwardly against spring 50.

Lower closure plug 34 is provided with a slotted recess 54 to receive lower end of arm 38 as it is swung inwardly (as shown in phantom in FIG. 4).

In order to provide a variety of different locking positions, arm 38 is provided with a plurality of serrated locking teeth 56, each of which has an upper or locking edge located essentially normal to the longitudinal axis of arm 38, and a lower ramped surface 58 for reasons described below.

The movable portion 18 of the magazine 10 comprises a generally planar flattened portion, and a generally annular side wall 60 extending around the flattened portion 18. Side wall 60 is extended to provide exit portion 62, adapted to register with exit portion 22 of fixed portion 16, whereby to guide the exit of fasteners from the magazine 10.

Integrally formed with portion 16 is a telescopic guide member 64 shaped in dimension to make a good sliding fit on sleeve 28. Guide member 64 is open at both ends, so that it may be slid onto and off the sleeve 28.

The interior of guide portion 64 is smooth, with the exception of the inwardly directed abutment member 66. Member 66 has an upwardly directed ramped surface 68, for cooperating with the ramped surfaces 58 of teeth 56. Abutment member 66 is dimensioned so that it may slide into and out of slot 36, and slot 30.

In this way the slots 36 and 30 provide a key way for guiding abutment 66. In this way the movable portion 18 registers with the fixed portion 16, and maintains the guide portions 62 and 22 in registration with one another.

Similarly, the abutment member 66 and in particular, the ramped portion 68 cooperates with the teeth 56 and the ramped portions 58 thereof, so as to permit the movable portion 18, and its telescopic guide 64 to be simply slipped over sleeve 28, and slid upwardly, until the correct position is reached, appropriate for the length of fasteners being used at the time. As the guide 64 is moved up sleeve 28, the abutment 66 will first of all enter the opening 36 and will then slide up the slot 30. The ramped portions 68 and 58 will cooperate with one another to cause arm 38 to swing inwardly, thereby permitting the teeth 56 to be progressively engaged by the abutment 66, one after the other in sequence.

In order to remove the movable portion 18, all that is required is to simply depress the finger plate 44, causing arm 38 to swing inwardly, after which the movable portion 18 can simply by withdrawn.

It will thus be noted that the fixed portion 16 may be made of rugged long-lasting construction, preferably being made of metal, with the sleeve 28 welded into the flat portion of the member 16. The movable portion 18 may be integrally formed, typically for example by injection molding using thermoplastic materials. Such materials have the advantage of being economical to manufacture, and in certain cases, it may be desirable to make such a movable portion 18 disposable. In this way, it may if desired, be used as part of the packaging for the coil of fastenings, so that an operator merely has to discard the movable portion 18 when the magazine 10 is empty, and then simply grasp a new package consisting of a coil of fastenings, and the removable portion 18, and place it in position.

On the other hand, it is not essential that it should be made disposable in this way. Since it is a part of the tool which will be repeatedly removed and replaced, it is likely to become damaged or even lost. Thus, the manufacturing techniques using injection molding will still permit such a component to be supplied at a relatively insignificant cost, thereby insuring that the owner of the fastening device can continue to use it without interruption.

Having described what is believed to be the best mode by which the invention may be performed, it will be seen that the invention may be particularly defined as follows:

A magazine for use in association with a fastener driving tool of the type employing fasteners associated together in a strip formed into a coil, such a magazine comprising a fixed portion adapted to be fastened to such a fastener driving tool, wall means forming a portion of said fixed portion for engaging said coil of fasteners, a mounting member associated with said fixed portion and extending along an axis centrally of a said coil of fasteners, a movable attachment member incorporated in said mounting member, and movable between locking and releasing positions, and in said locking position, extending outwardly with respect to said mounting member, a movable magazine portion defining wall means adapted to engage a said coil of fasteners, exit means on at least one of said fixed and movable magazine portions, for permitting exit of said fastenings as they are withdrawn from said magazine, a slidable guide member formed on said movable portion, being dimensioned and shaped to be interengageable with said mounting member, and removed therefrom, and locking abutment means located inwardly of said guide member, for interengaging with said locking means on said fixed magazine portion.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A magazine for use in association with a fastener driving tool of the type employing fasteners associated together in a strip formed into a coil, such a magazine comprising;

a fixed portion adapted to be fastened to such a fastener driving tool;

wall means forming a portion of said fixed portion for engaging said coil of fasteners;

a mounting member associated with said fixed portion and extending along an axis centrally of a said coil of fasteners;

a movable attachment member incorporated in said mounting member, and movable between locking and releasing positions, and in said locking position, extending outwardly with respect to said mounting member;

a movable magazine portion defining wall means adapted to engage a said coil of fasteners;

exit means on at least one of said fixed and movable magazine portions, for permitting exit of said fastenings as they are withdrawn from said magazine;

a slidable guide member formed on said movable portion, being dimensioned and shaped to be interengageable with said mounting member, and removed therefrom, and, locking abutment means located inwardly of said guide member, for interengaging with said locking means on said fixed magazine portion.

2. A magazine as claimed in claim 1 wherein said fixed portion comprises a flattened sheet portion, with said wall means depending downwardly around the perimeter thereof, and wherein said mounting member is attached to said flattened sheet portion, and extends normal thereto.

3. A magazine as claimed in claim 2 including a mounting portion extending axially relative to said mounting member on the opposite side of said flattened sheet portion, and wherein said movable attachment member extends from said movable mounting member into said mounting portion, and including pivot means in said mounting portion connected to said movable attachment member, for pivotally mounting said movable attachment member therein.

4. A magazine as claimed in claim 2 wherein said mounting member comprises a generally hollow sleeve-like construction, and including an elongated slotted opening therein, for receiving said locking abutment means.

5. A magazine as claimed in claim 4 including a closure member for the free end of said mounting member, and including groove mens formed in said member aligning with said slotted opening.

6. A magazine as claimed in claim 4 wherein said movable attachment member comprises an elongated arm portion extending downwardly within said mounting member, and including a plurality of tooth members on said arm member, said tooth members extending outwardly through said slotted opening.

7. A magazine as claimed in claim 4 including spring means engaging said movable attachment member, and urging said arm member to swing outwardly through said slotted opening, said mounting member being swingable against said spring means, to permit said arm member to swing inwardly into said mounting member.

8. A magazine as claimed in claim 2 wherein said movable magazine portion comprises a generally flattened sheet member, said wall means extending around the periphery of said sheet member, and wherein said slidable guide member is formed integrally with said sheet member, and extends normal thereto.

9. A magazine as claimed in claim 8 wherein said slidable guide member is of generally hollow, sleeve-like construction open at both ends, and being dimensioned and shaped to make a sliding fit on said movable attachment member.

10. A magazine as claimed in claim 9 including locking abutment means extending inwardly from said slidable guide member and formed integrally therewith.

* * * * *